US012274334B2

(12) United States Patent
Feng et al.

(10) Patent No.: US 12,274,334 B2
(45) Date of Patent: Apr. 15, 2025

(54) STOP MEMBER OF SLIDE FASTENER AND METHOD OF PRODUCING SLIDE FASTENER

(71) Applicant: YKK Corporation, Tokyo (JP)

(72) Inventors: Tiantian Feng, Kurobe (JP); Kazuo Tamura, Kurobe (JP); Shintaro Metani, Kurobe (JP); Atsushi Takata, Kurobe (JP)

(73) Assignee: YKK Corporation, Tokyo (JP)

( * ) Notice: Subject to any disclaimer, the term of this patent is extended or adjusted under 35 U.S.C. 154(b) by 10 days.

(21) Appl. No.: 18/547,275

(22) PCT Filed: Mar. 11, 2021

(86) PCT No.: PCT/JP2021/009924
§ 371 (c)(1),
(2) Date: Aug. 21, 2023

(87) PCT Pub. No.: WO2022/190332
PCT Pub. Date: Sep. 15, 2022

(65) Prior Publication Data
US 2024/0122309 A1 Apr. 18, 2024

(51) Int. Cl.
*A44B 19/60* (2006.01)
*A44B 19/36* (2006.01)

(52) U.S. Cl.
CPC ..... *A44B 19/60* (2013.01); *A44B 19/36* (2013.01)

(58) Field of Classification Search
CPC ..... A44B 19/60; A44B 19/36; A44B 19/38; Y10T 24/2593
See application file for complete search history.

(56) References Cited

U.S. PATENT DOCUMENTS 3,030,684 A * 4/1962 La Moine ..... A44B 19/38 24/434
5,653,002 A * 8/1997 Ishihara ..... A44B 19/36 24/433
5,755,014 A * 5/1998 Yamaguchi ..... A44B 19/38 24/433
(Continued)

FOREIGN PATENT DOCUMENTS

JP S59-025217 U 2/1984
JP 2005-323860 A 11/2005
(Continued)

OTHER PUBLICATIONS

International Search Report, PCT Patent Application No. PCT/JP2021/009924, May 25, 2021, 4 pages.
(Continued)

*Primary Examiner* — Jason W San
*Assistant Examiner* — Louis A Mercado
(74) *Attorney, Agent, or Firm* — Kilpatrick Townsend & Stockton LLP

(57) ABSTRACT

Stop member for slide fastener includes: a main body having first and second surfaces; a first superficial region formed at a side of the first surface of the main body; and a slit or interface interposed between the first and second surfaces of the main body. The first superficial region extends over and covers the slit or interface, and has a thickness defined between the first surface and an end of the slit or interface at the side of the first surface.

13 Claims, 16 Drawing Sheets

(56) References Cited

U.S. PATENT DOCUMENTS

| | | | | |
|---|---|---|---|---|
| 9,565,905 | B2 * | 2/2017 | Huang | A44B 19/36 |
| 2005/0251975 | A1 | 11/2005 | Segawa et al. | |
| 2021/0378368 | A1 | 12/2021 | Metani | |

FOREIGN PATENT DOCUMENTS

| | | | |
|---|---|---|---|
| JP | 4191089 | B2 | 9/2008 |
| WO | 2020/115886 | A1 | 6/2020 |

OTHER PUBLICATIONS

International Preliminary Report on Patentability, PCT Patent Application No. PCT/JP2021/009924, Sep. 12, 2023, 5 pages.

* cited by examiner

STOP MEMBER OF SLIDE FASTENER AND METHOD OF PRODUCING SLIDE FASTENER

TECHNICAL FIELD

The present disclosure concerns a stop member of slide fastener and a method of producing a slide fastener.

BACKGROUND ART

Technology is known where divided pieces respectively secured to left and right fastener tapes are coupled to form a stop member as a stop member of slide fastener. In patent literature 1, first and the second divided pieces are coupled, and respective overlapping steps thereof are melted together based on ultrasonic heating to form a stop member (See FIGS. 1 to 7 of patent literature 1). In patent literature 2, first and second members are meshed to form a stop member (See FIGS. 1 to 7 of patent literature 2).

Note that, in patent literature 3, a resin of fastener element is used to form a stop member. In particular, a fastener element is arranged in a mold cavity, and the fastener element is remolded (See FIG. 15 of (patent literature 3).

CITATION LIST

Patent Literature

[PTL 1] Japanese examined utility-model application Laid-open No. 59-25217

[PTL 2] Japanese patent No. 4191089

[PTL 3] International Publication No. 2020/115886

SUMMARY

Technical Problem

The present inventors have newly identified a technical challenge to ensure a desired strength of stop member produced through coupling divided pieces and simultaneously, to suppress deterioration of appearance of the stop member compared with a stop member produced through one-shot injection molding.

Solution to Problem

A stop member for slide fastener according to an aspect of the present disclosure, the stop member including: a main body having first and second surfaces; a first superficial region formed at a side of the first surface of the main body; and a slit or interface interposed between the first and second surfaces of the main body. The first superficial region extends over and covers the slit or interface, and has a thickness defined between the first surface and an end of the slit or interface at the side of the first surface.

The first and second surfaces may be uneven or flat surfaces. Protrusion or recess or combination of them may be formed on the first and second surfaces to display a pattern such as a logo. In an example, the first surface is a top surface of the main body, and the second surface is a bottom surface of the main body, and the top and bottom surfaces both are flat surfaces that extend over the slit or interface.

The stop member may further include a second superficial region formed at a side of the second surface of the main body. The second superficial region extends over and covers the slit or interface, and has a thickness defined between the second surface and an end of the slit or interface at the side of the second surface. Typically, the first surface is a top surface of the main body, and the second surface is a bottom surface of the main body, but should not be limited to this. Advantageously, the slit or interface is not exposed in both of the first and second surfaces. In some cases, the main body further has a front surface and a rear surface arranged at an opposite side of the front surface, and the first superficial region covers the slit or interface in a full span of the slit or interface in front-rear direction between the front surface and the rear surface of the main body. The second superficial region covers the slit or interface in a full span of the slit or interface in front-rear direction between the front surface and the rear surface of the main body.

In some embodiments, the thickness of the first superficial region and/or the thickness of the second superficial region is equal to or greater than 0.2 mm or is equal to or less than half a thickness defined by the first and second surfaces of the main body.

In some embodiments, the main body may further have a third surface and a fourth surface arranged at an opposite side of the third surface. Third superficial region is formed at a side of the third surface to prevent at least a part of the slit or interface from being exposed in the third surface. Fourth superficial region is formed at a side of the fourth surface to prevent at least a part of the slit or interface from being exposed in the fourth surface.

In some embodiments, a number of the slit or interface observed in a given cross section of the main body is equal to or greater than 2 or 3. The given cross section is obtained, in an example, in a central line of stop member, but other various planes may be employed such as a plane orthogonal to the central line, and a plane forming an acute angle with the central line.

In some embodiments, the slit or interface is formed to demarcate a boundary between a female portion and a male portion included in the main body.

A method of producing a slide fastener according to another aspect of the present disclosure includes: injection molding at least one first resin portion, which will be a part of a stop member, to a side-edge portion of a first fastener tape; injection molding at least one second resin portion, which will be a remaining part of the stop member, to a side-edge portion of a second fastener tape; arranging the first and second resin portions in a cavity of a mold to form a slit between the first and second resin portions; heating the mold to melt superficial regions of the first and second resin portions in the cavity of the mold such that the slit is partially filled by melted resin of the superficial regions; and cooling the mold to form a stop member that has a slit or interface covered by at least one superficial region made of a solidified resin of the melted resin.

In some embodiments, the method further includes: coupling the first and second resin portions based on engagement between female portion and male portion of the first and second resin portions in advance of said arranging the first and second resin portions in the cavity of the mold.

In some embodiments, a row of first fastener elements is injection-molded to the side-edge portion of the first fastener tape, and a row of second fastener elements is injection-molded to the side-edge portion of the second fastener tape. Slider designed for engaging the female portion and the male portion of the first and second resin portions may be used to engage the first and second fastener elements one another.

In some embodiments, a stop member having no gate mark is formed through heating and cooling of the mold. For example, no gate mark is formed on the main body.

Advantageous Effects of Invention

According to an aspect of the present disclosure, it would be achieved to ensure a desired strength of stop member and simultaneously, to suppress deterioration of appearance of the stop member.

DESCRIPTION OF EMBODIMENTS

Hereinafter, various embodiments and features would be discussed with reference to FIGS. 1-16. A skilled person would be able to couple respective embodiments and/or respective features without requiring excess description, and would appreciate synergistic effects of such combinations. Overlapping descriptions among the embodiments are basically omitted. Referenced drawings aim mainly for describing inventions and are simplified for the sake of convenience of illustration. The respective features should be appreciated as universal features not only effective to stop member for slide fastener and method of producing slide fastener presently disclosed but also effective to other various stop members for slide fastener and methods of producing slide fastener not disclosed in the present specification.

In the present specification, front-rear direction should be understood based on a movement direction of slider. Left-right direction should be understood based on a pair of fastener stringers coupled and decoupled by the slider. Up-down direction is orthogonal to the front-rear and left-right directions. These terminologies can be redefined based on the following descriptions.

Slide fastener 1 is attached to various items such as bags, clothes and shoes, enabling opening and closing of the items. The slide fastener 1 has left and right (first and second) fastener stringers 2*a*,2*b* in which left and right (first and second) fastener elements 4*a*,4*b* are aligned on opposing side-edge portions 3*c*,3*d* of left and right (first and second) fastener tapes 3*a*,3*b*; a slider that moves forward to engage the left and right fastener elements 4*a*,4*b* and moves rearward to disengage the left and right fastener elements 4*a*,4*b*; and a rear stop (stop member) 7 that is arranged adjacent to rear ends of the rows of left and right fastener elements and interconnects the left and right fastener tapes 3*a* and 3*b*. The left and right fastener stringers 2*a*, 2*b* are respectively provided with front stops 6*a*, 6*b*. Note that, the slide fastener 1 should not be limited to the illustrated type but may be a so-called conceal slide fastener.

The fastener tape 3*a*,3*b* is a flexible member having a thickness defined by upper and lower tape surfaces and in most cases, is a woven web or knitted web or mixture of the two. The fastener tape 3*a*,3*b* is elongated in the front-rear direction with a constant width in the left-right direction. Arrangement of core threads in the respective side-edge portions 3*c*,3*d* of the fastener tapes 3*a*,3*b* facilitates that the fastener elements 4*a*,4*b* are more firmly secured to the side-edge portions 3*c*,3*d*.

Figure 1:
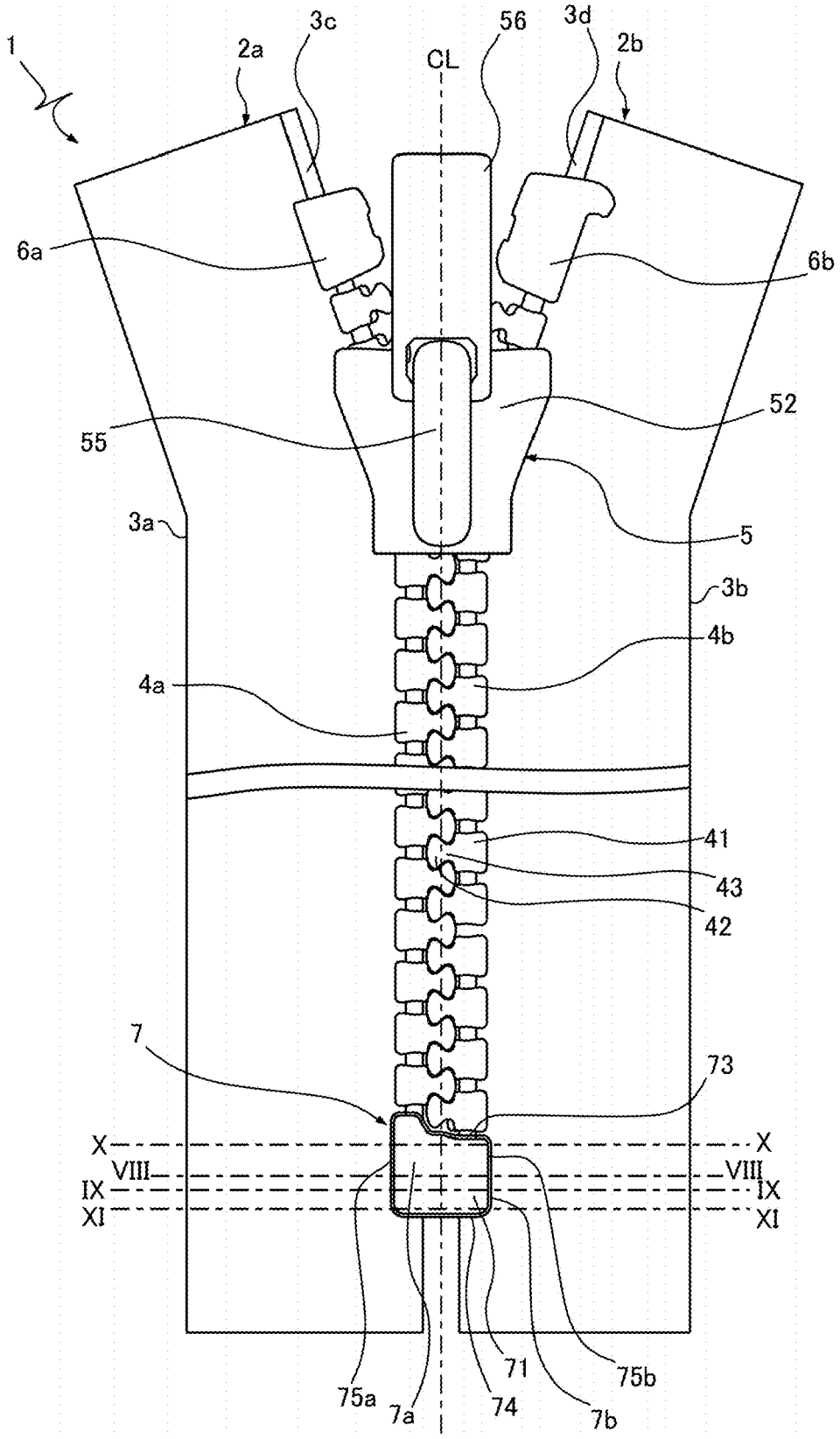
FIG. 1 is a top view of a slide fastener according to an aspect of the present disclosure.

The fastener elements 4*a*,4*b* are resin elements for example but should not be limited to this, and may be metal elements or ceramics elements or coil-like element. The fastener elements 4*a*,4*b* are attached to the side-edge portion 3*c*,3*d* (e.g. a core thread) of the fastener tape 3*a*,3*b*. The fastener element 4*a*,4*b* has a base portion 41, a head 42 and a neck 43 interposed between them as illustrated in FIG. 1 in a case where it is made of resin, but such a shape is just an example only. Note that the ceramics element is an element at least partially includes ceramics, and needs not to be made of ceramics entirely. The coil-like element is a helically wound monofilament. The metal element is one which is widely known.

The front stop 6*a*,6*b* may be made of metal or resin or ceramics similar to the fastener element 4*a*,4*b*. Of course, the front stop 6*a*,6*b* can be omitted. The rear stop 7 has a top surface (first surface) 71 and a bottom surface (second surface) 72 and further has a main body 7*a* having a thickness defined between the top and bottom surfaces 71, 72. The main body 7*a* further has a front surface (third surface) 73, a rear surface (fourth surface) 74, a left-side surface (fifth surface) 75*a*, and a right-side surface (sixth surface) 75*b*. Details of the rear stop 7 will be discussed below. The top surface 71 and the bottom surface 72 both are flat surfaces perpendicular to the up-down direction and extending over a slit or interface 8 discussed below but, they may not necessarily be a flat surface. Additionally to the main body 7*a*, the rear stop 7 has a rim 7*b* that protrudes outward from the main body 7*a* at a center in thickness of the main body 7*a* defined by the top and bottom surfaces 71,72. This is formed corresponding to a space to which a resin fled in a mold 100 described below. The rim 7*b* may be an annular portion that surrounds the main body 7*a*.

Figure 4:
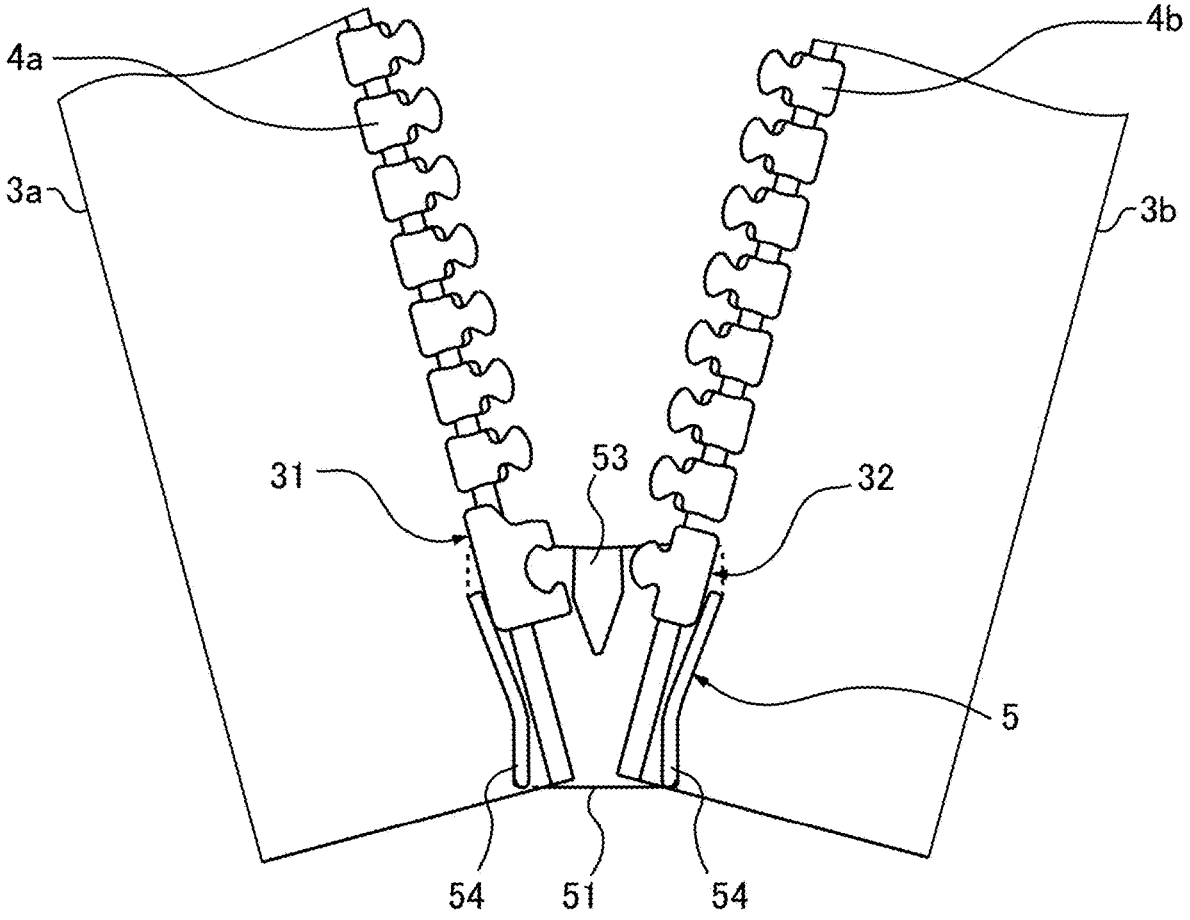
FIG. 4 is a schematic illustration illustrating that female and male portions of first and second resin portions are engaged by a slider.
Figure 5A:
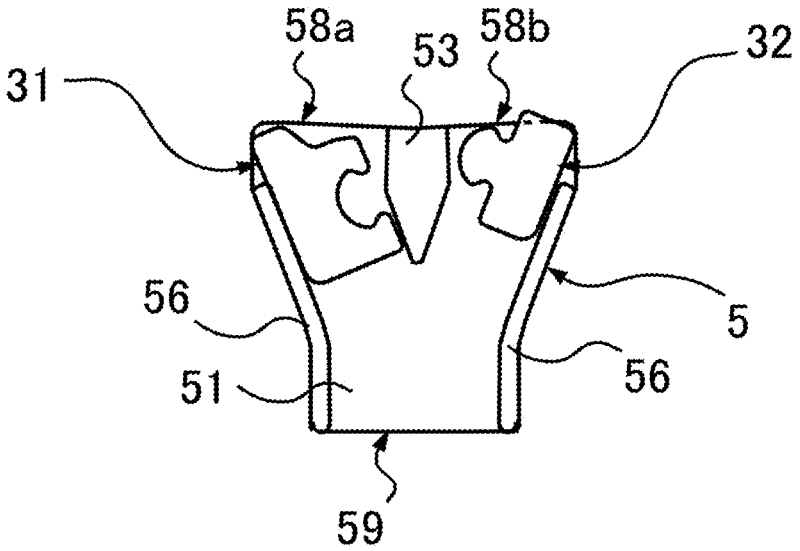
FIGS. 5 (A), 5 (B), and 5 (C), collectively FIG. 5 are schematic illustrations illustrating a process of engagement between the female and male portions of first and second resin portions in (A) to (C) in this order.
Figure 5B:
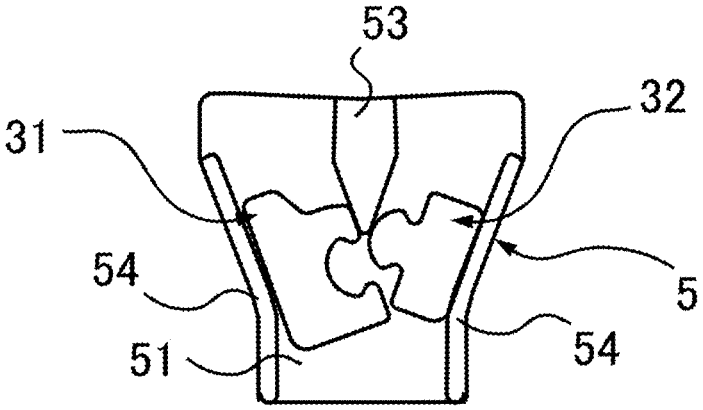
Figure 5C:
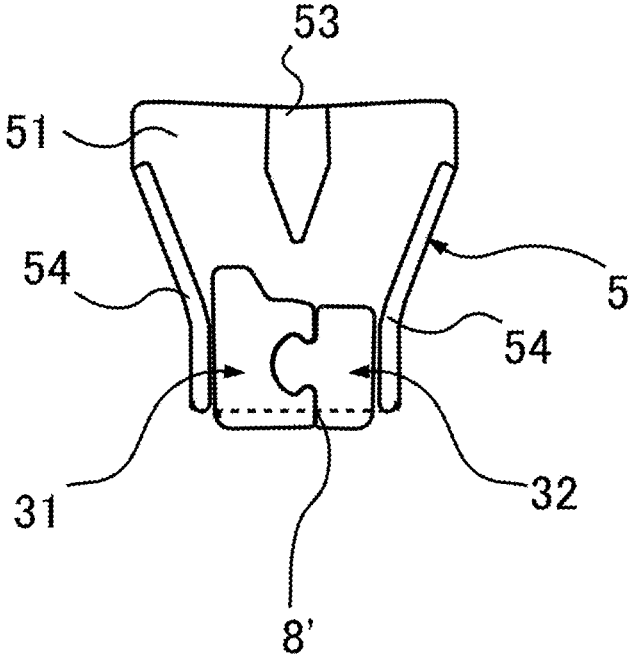

The slider 5 may be made of metal or resin or ceramics similar to the fastener element 4*a*,4*b* and the front stop 6*a*,6*b*. Structure of the slider 5 may be appropriately designed in accordance with a type of slide fastener 1. As illustrated in FIGS. 1, 4 and 5, the slider 5 has a bottom wing 51, a top wing 52, a coupling pillar 53 that couples these wings, and flanges 54 respectively arranged on the bottom wing 51 and the top wing 52, a pull tab attachment portion 55 arranged on the top surface of the top wing 52, and a pull tab 56 attached to the pull tab attachment portion 55. The coupling pillar 53 forms a Y-shaped element passage inside the slider 5, and the flanges 54 prevents the fastener elements 4*a*,4*b* from deviating off the element passage. Left and right front mouths 58*a*,58*b* are arranged adjacent to and at both sides of the coupling pillar 53, and one rear mouth 59 is arranged opposite to the front mouths 58*a*,58*b*.

As the slider 5 moves forward, the left and right fastener elements 4*a*,4*b* enter into the inside of the slider 5 through the left and right front mouths 58*a*,58*b* individually, and are engaged at a rear position of the coupling pillar 53 owing to the coupling pillar 53 and then exit from the slider 5 via the rear mouth 59. As the slider 5 moves rearward, the engaged left and right fastener elements 4*a*,4*b* enter into the inside of the slider 5 via the rear mouth 59, and are disengaged at a rear position of the coupling pillar 53 owing to the coupling pillar 53 and then exist from the slider 5 via the front mouths 58*a*,58*b* separately.

The rear stop 7 may be produced by coupling (See FIGS. 4 and 5) at least one first resin portion 31 (See FIG. 2), which will be a part of the rear stop 7, and at least one second resin portion 32 (See FIG. 3), which will be a remaining part of the rear stop 7; arranging this in a cavity 105 of a mold 100 (See FIGS. 6 and 7); heating the mold 100 to melt superficial regions of the first and second resin portions 31,32 in the cavity 105; and cooling the mold 100 following the heating. According to such processes, resin of the superficial regions of the first and second resin portions 31 and 32 is melted to partially fill a slit 8' between the first and second resin portions 31 and 32 in the cavity 105 of the mold 100, and the slit 8' is covered by a superficial layer made of the melted and solidified resin. This ensures a desired strength of stop member and simultaneously, allows suppression of deterioration of appearance of stop member. In particular, the superficial layer made of the melted and solidified resin increases a strength of the rear stop 7 (in other words, a coupling strength of divided pieces of the first and second resin portions 31 and 32) and prevents exposure of the slit or interface 8 in the rear stop 7.

In cases where the fastener element 4*a*,4*b* is made of resin, the first resin portion 31 which will configure the rear stop 7 can be injection-molded simultaneously as the fastener elements 4*a* are injection molded, reducing a burden of color management of the fastener elements 4*a* and the first resin portion 31. The same applies to the fastener elements 4*b* and the second resin portion 32. In cases where a rear stop is formed through one shot injection molding, injection molding for the rear stop is performed at a separate timing later from a timing of injection molding for fastener elements, and there is a burden of management of resin material and also a burden of management or operation of injection molding apparatus.

The first resin portion 31 is attached to the side-edge portion 3*c* (the core thread) of the fastener tape 3*a* at a position adjacent to the rear end of the row of left-side fastener elements 4*a*. The first resin portion 31 has a base portion 31*a* adhering to the fastener tape 3*a*, and an extended portion 31*b* extended outward of fastener tape. The extended portion 31*b* includes a female portion 31*c* recessed inward of fastener tape. The female portion 31*c* has a recess 31*p* and a constricting portion 31*q* having a pair of protrusions arranged with an interspace and to constrict an entrance of the recess 31*p*. The recess 31*p* is recessed so as to receive a head 32*e* of a male portion 32*c* described below. The constricting portion 31*q* is engaged with a neck 32*d* of the male portion 32*c* described below. Note that the female portion 31*c* does not necessarily recessed inward of fastener tape. The female portion 31*c* may be a portion recessed in a different direction, e.g. upward or downward. The base portion 31*a* is provided with a protrusion 31*d* protruding forward relative to the extended portion 31*b*, but can be omitted.

The above-described outward and inward of fastener tape can be defined as follows. The outward of fastener tape is a direction directed from a point on a tape surface of a fastener tape to a point outside of the tape surface, including a direction traversing the core thread. The inward of fastener tape is a direction directed from a point outside of a tape surface of a fastener tape to a point on the tape surface, including a direction traversing the core thread.

Figure 2:
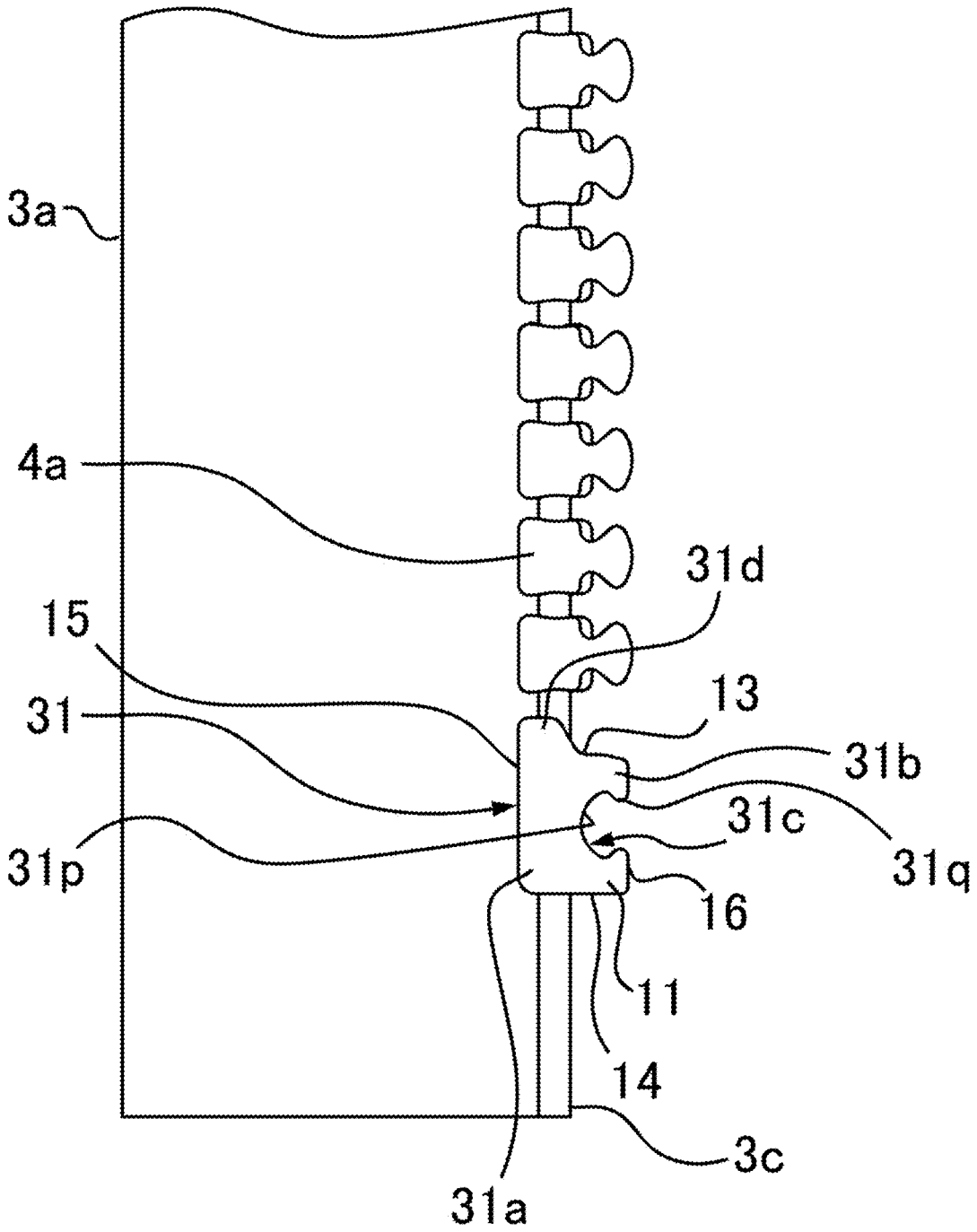
FIG. 2 is a top view of a left stringer used for production of the slide fastener shown in FIG. 1.

The first resin portion 31 has a top surface 11, a bottom surface 12, a front surface 13, a rear surface 14, a left-side surface (a surface facing inward of fastener tape) 15 and a right-side surface (a surface facing outward of fastener tape) 16 (See FIG. 2). The top surface 11 is formed in a same plane as a top surface of the fastener element 4*a* or formed farther away from the tape top surface of the fastener tape 3*a* than the top surface of the fastener element 4*a*. The bottom surface 12 is formed in a same plane as a bottom surface of the fastener element 4*a* or formed farther away from the tape bottom surface of the fastener tape 3*a* than bottom surface of the fastener element 4*a*. Slope is formed in the front surface 13 to configure the above-described protrusion 31*d*. Recess is formed in the right-side surface 16 to configure the above-described female portion 31*c*. Note that tape-inward regions of the front and rear surfaces 13 and 14 include top and bottom regions sectioned by the fastener tape 3*a*. The left-side surface 15 includes top and bottom regions sectioned by the fastener tape 3*a*.

The second resin portion 32 is attached to the side-edge portion 3*d* (the core thread) of the fastener tape 3*b* at a position adjacent to the rear end of the row of right-side fastener elements 4*b*. The second resin portion 32 has a base portion 32*a* adhering to the fastener tape 3*b*, and an extended portion 32*b* extended outward of fastener tape. The extended portion 32*b* includes a male portion 32*c* protruding outward of fastener tape. In some cases including the illustrated example, the male portion 32*c* has a neck 32*d* and a head 32*e* in a direction away from the base portion 32*a* outward of fastener tape. The neck 32*d* is narrower than the head 32*e* (in front-rear direction) and will be engaged with the constricting portion of the female portion 31*c* described above.

Figure 3:
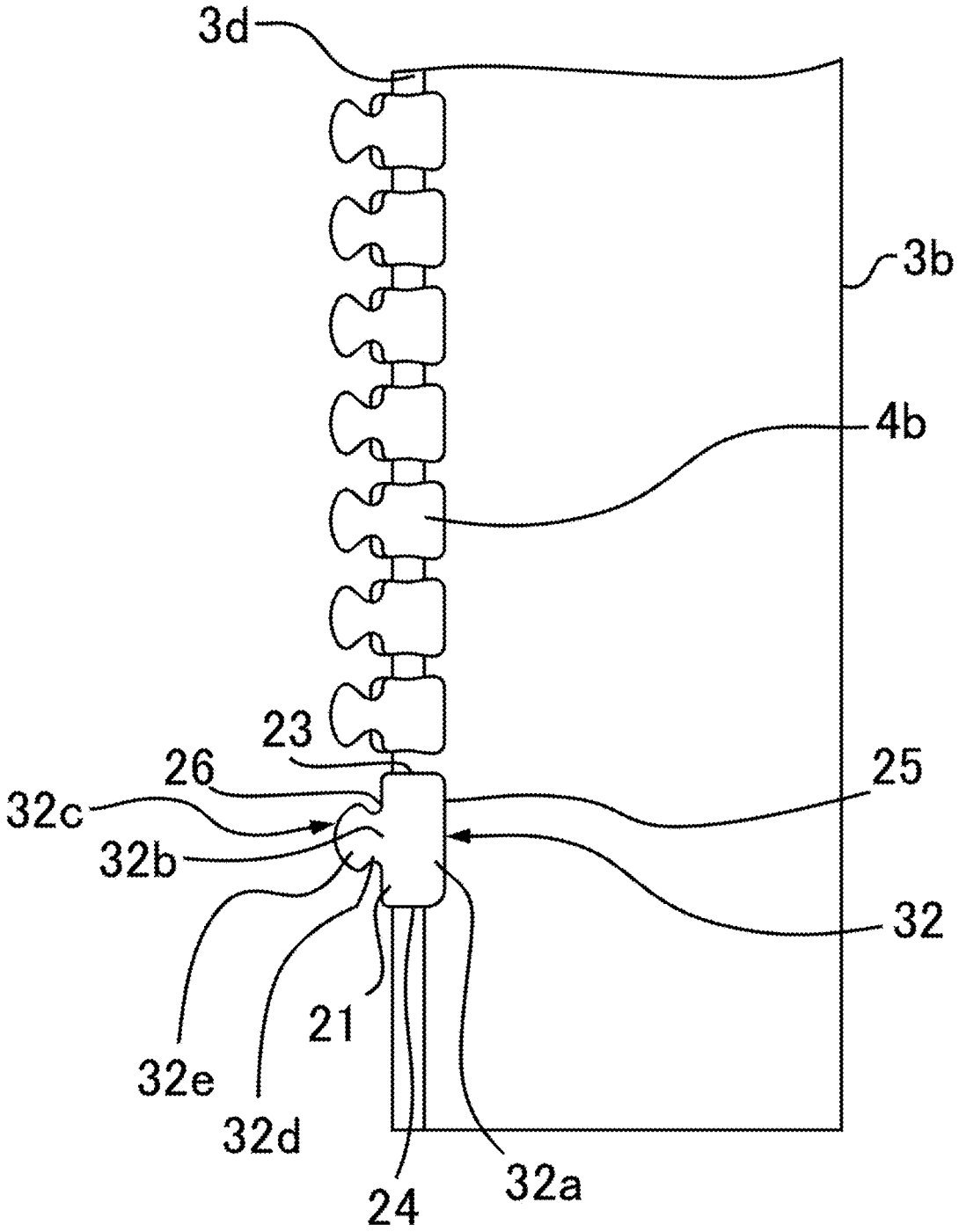
FIG. 3 is a top view of a right stringer used for production of the slide fastener shown in FIG. 1.

The second resin portion 32 has a top surface 21, a bottom surface 22, a front surface 23, a rear surface 24, a right-side surface (a surface facing inward of fastener tape) 25, and a left-side surface (a surface facing outward of fastener tape) 26 (See FIG. 3). The description made for the top and bottom surfaces 11 and 12 of the first resin portion 31 is equally applicable to the top and bottom surfaces 21 and 22 of the second resin portion 32. Protrusion is formed in the left-side surface 26 to configure the above-described male portion 32*c*. The male portion 32*c* does not necessarily protruding outward of fastener tape. The male portion 32*c* may be a portion protruding in a different direction, e.g. upward or downward.

As illustrated in FIGS. 4 and 5, the first resin portion 31 enters into the inside of the slider 5 via the front mouth 58*a* and the second resin portion 32 enters into the inside of the slider 5 via the front mouth 58*b*, the female portion 31*c* of the first resin portion 31 and the male portion 32*c* of the second resin portion 32 start to engage at a rear position of the coupling pillar 53, and the (engaged) first and second resin portions 31,32 exit the slider 5 via the rear mouth 59 in a fully engaged condition. The first and second resin portions 31 and 32 are separate resin portions, they are engaged though. Therefore, there is a slit 8' formed between the portions 31 and 32. Note that the first and second resin portions 31 and 32 may be disengageable by the same slider 5 even after engaged as described above, not necessarily limited to this though. The slit 8' is visible in the top surface, in the bottom surface, in the front surface, and in the rear surface of the engaged first and second resin portions 31 and 32.

Figure 6:
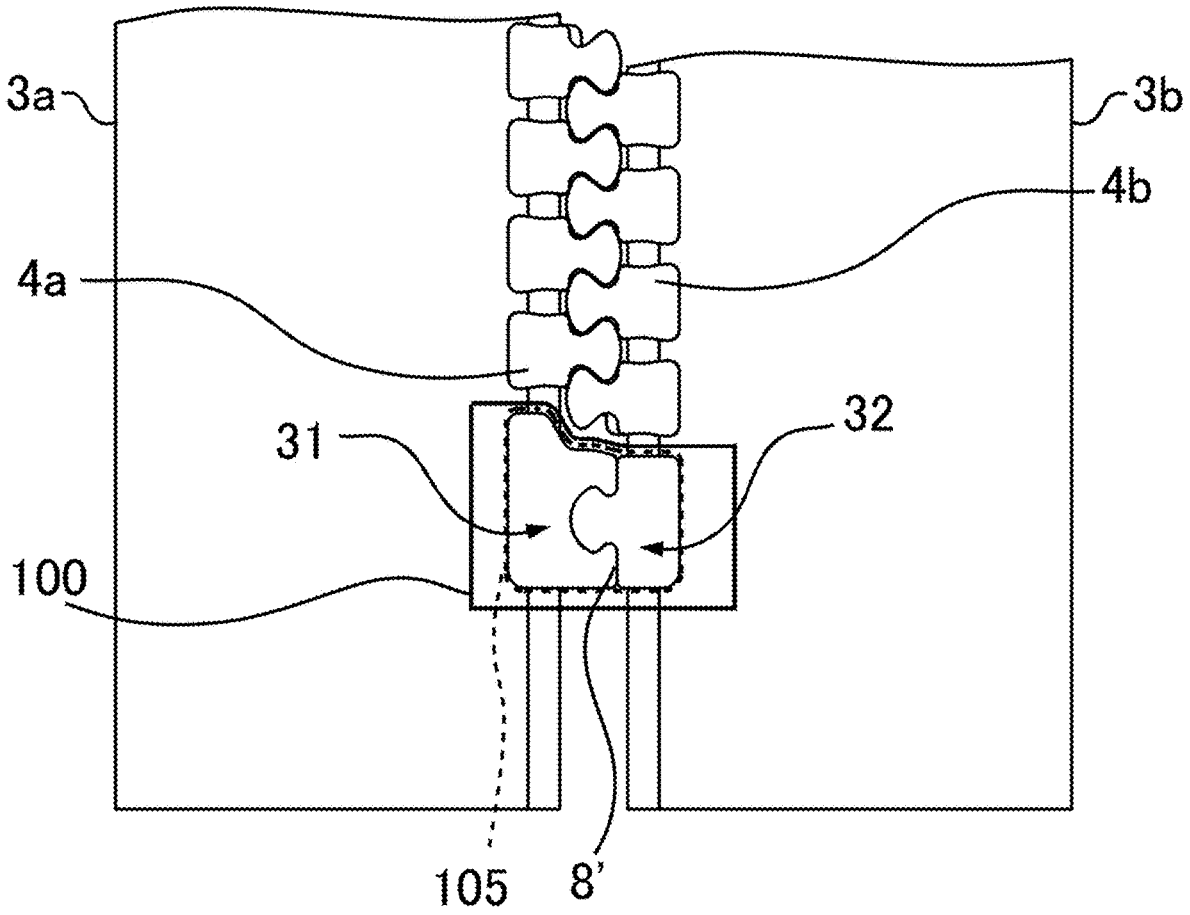
FIG. 6 is a schematic illustration illustrating a condition where the first and second resin portions are arranged in a mold cavity.
Figure 7A:
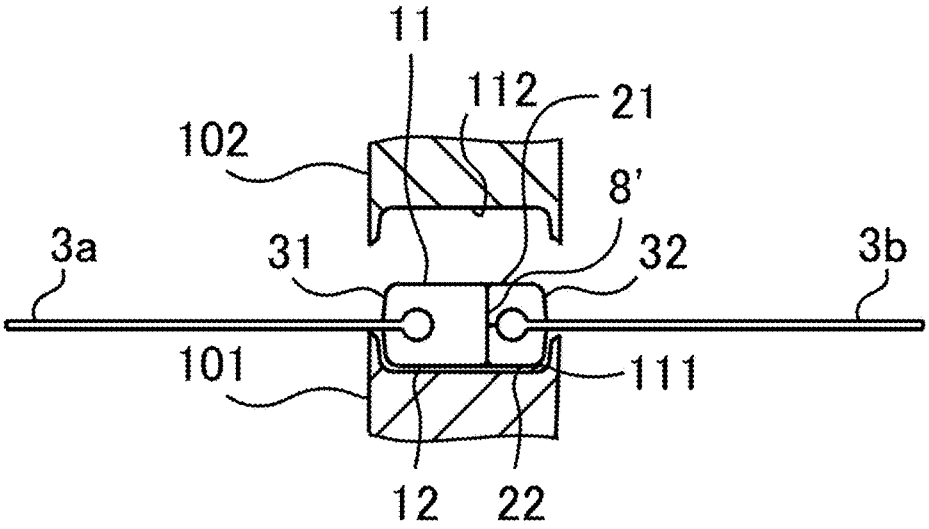
FIGS. 7 (A), 7 (B), and 7 (C), collectively FIG. 7 are schematic illustrations illustrating a process in which first and second resin portions are arranged in a mold cavity in (A) to (C) in this order.
Figure 7B:
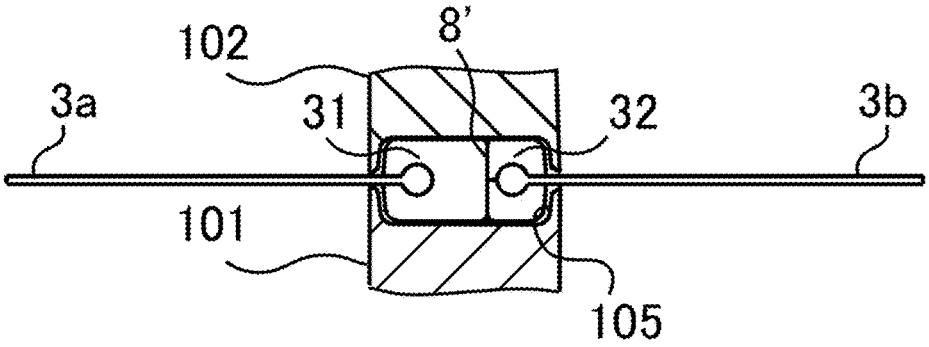
Figure 7C:
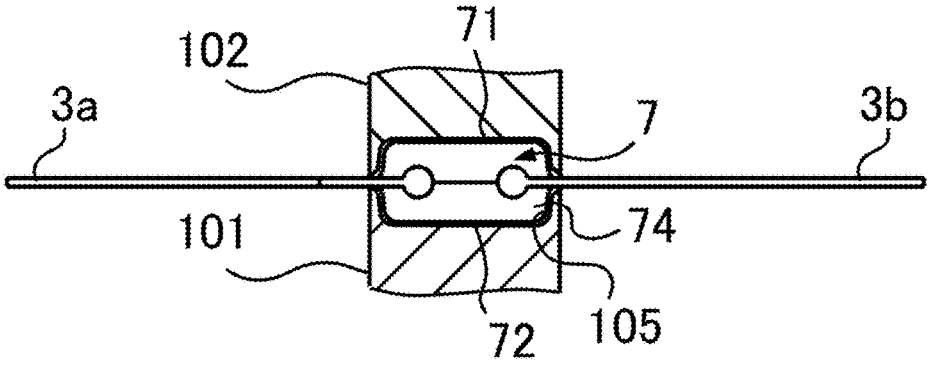

The first and second resin portions 31,32 are arranged in a cavity 105 of a mold 100 (See FIGS. 6 and 7). For example, the first and second resin portions 31,32 are arranged in a cavity 111 of a lower mold 101, and the upper mold 102 is lowered to the lower mold 101. As the upper mold 102 is stacked to the lower mold 101, the cavity 111 of the lower mold 101 and the cavity 112 of the upper mold 102 form the cavity 105 together.

The top surfaces 11,21 of the first and second resin portions 31,32 are opposed to, and positioned in the vicinity of or in contact with the bottom surface of the cavity 112 of the upper mold 102. The bottom surfaces 12,22 of the first and second resin portions 31,32 are opposed to, and positioned in the vicinity of or in contact with the bottom surface of the cavity 111 of the lower mold 101.

Upper halves of the front surfaces 13,23 of the first and second resin portions 31,32 are opposed to, and positioned in the vicinity of or in contact with a front-side wall surface of the cavity 112 of the upper mold 102. Lower halves of the front surfaces 13,23 of the first and second resin portions 31,32 are opposed to, and positioned in the vicinity of or in contact with a front-side wall surface of the cavity 111 of the lower mold 101. The description made for the front surface 13,23 of the first and second resin portion 31,32 is equally applicable to the rear surface 14,24 of the first and second resin portions 31,32, and also to side surfaces facing inward of fastener tape of the first and second resin portions 31,32 (i.e. the left-side surface 15 and the right-side surface 25).

The right-side surface 16 and the left-side surface 26 of the first and second resin portions 31,32 (both of which are sides facing outward of fastener tape) are opposing to one another or are in contact. That is, these side surfaces do not directly face and touch a cavity surface of any of the lower mold 101 and the upper mold 102. As a result of this, a part of the slit 8' between the first and second resin portions 31,32 remains as a slit or interface 8 in the rear stop 7 even though the superficial layers of the first and second resin portions 31,32 are melted in the cavity 105 of the mold 100.

The mold 101 is heated up while the first and second resin portions 31,32 are arranged in the cavity 104 of the mold 100, and the superficial layers of the first and second resin portions 31,32 are melted to allow melted resin of the superficial layers to partially fill the slit 8' between the first and second resin portions 31 and 32. The heating of the mold 100 can be done by various methods such as electrical conduction of heating coil wound about the mold 100. Target temperature and duration of the target temperature may be determined by a skilled person in the art experimentally based on resin material and size of the first and second resin portions 31,32.

The mold 100 is heated and then cooled. For example, the mold 100 is cooled by a fluid flowing through a channel formed in the mold 100. As the mold 100 is cooled, melted resin in the cavity 105 of the mold 100 is solidified to be a superficial layer of the rear stop 7. The superficial layer may be one of first to fourth superficial regions described below, for example.

Figure 8A:
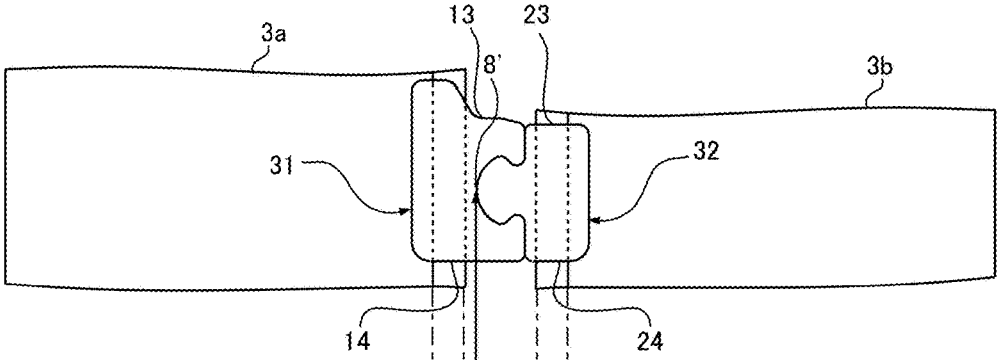
FIGS. 8 (A) and 8 (B), collectively FIG. 8 are schematic illustrations illustrating a correspondence between a slit formed between the first and second resin portions and a slit (or an interface (omitted hereinafter)) formed in a stop member, FIG. 8 (A) illustrating the first and second resin portions before heated and melted, and FIG. 8 (B) illustrating a cross section of the stop member taken along a dash line VIII-VIII in FIG. 1. Double headed arrow indicates correspondence between the slit shown in FIG. 8 (A) and the slit shown in FIG. 8 (B) is indicated.
Figure 8B:
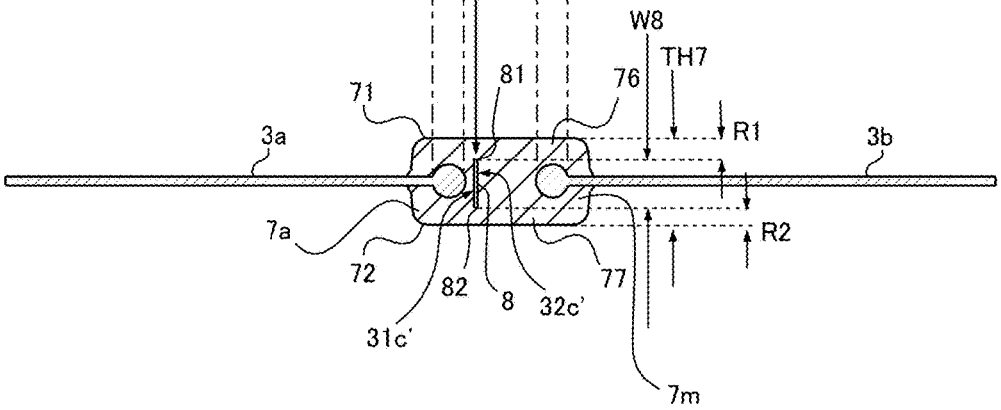
Figure 9A:
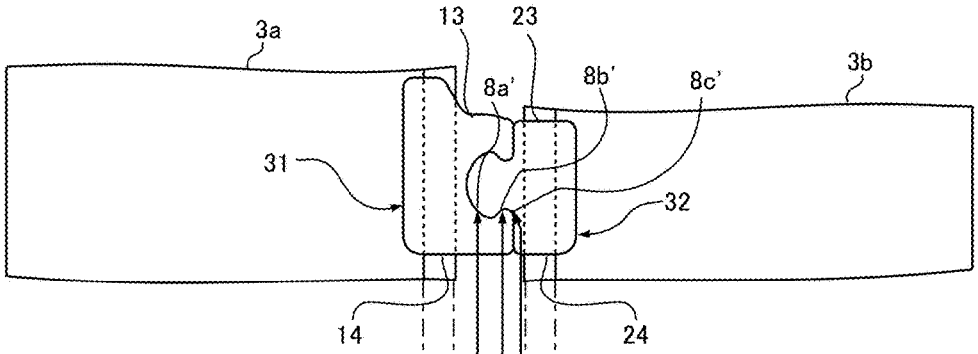
FIGS. 9 (A) and 9 (B), collectively FIG. 9 are schematic illustrations illustrating a correspondence between a slit formed between the first and second resin portions and a slit formed in a stop member, FIG. 9 (A) illustrating the first and second resin portions before heated and melted, and FIG. 9 (B) illustrating a cross section of the stop member taken along a dash line IX-IX in FIG. 1. Correspondence is indicated by a double headed arrow similar to FIG. 8.
Figure 9B:
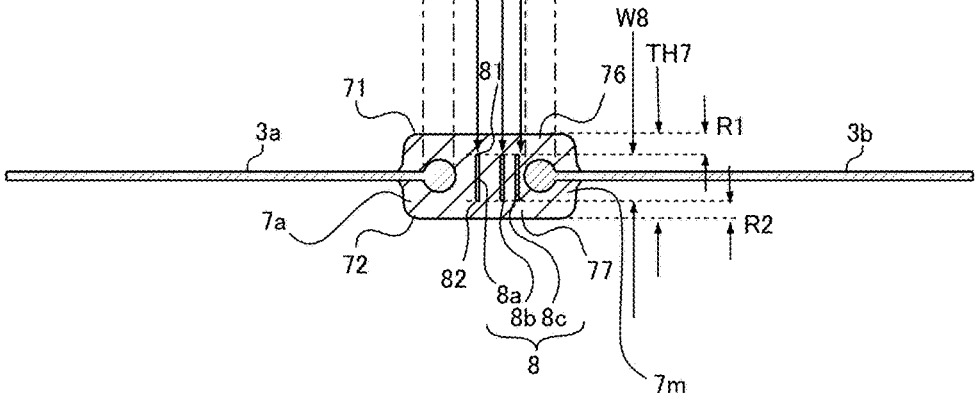
Figure 10A:
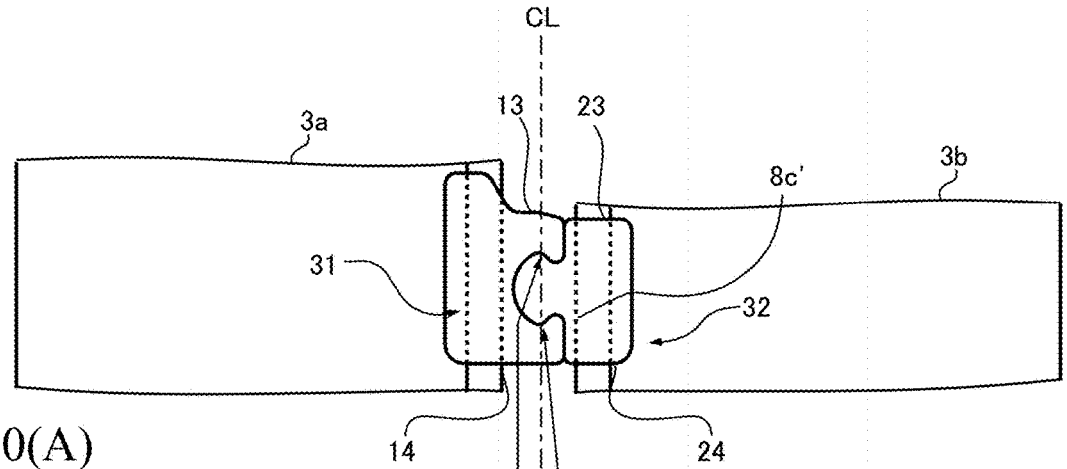
FIGS. 10 (A) and 10 (B), collectively FIG. 10 are schematic illustrations illustrating a correspondence between a slit formed between the first and second resin portions and a slit formed in a stop member, FIG. 10 (A) illustrating the first and second resin portions before heated and melted, and FIG. 10 (B) illustrating a cross section of the stop member taken along a central line CL in FIG. 1.
Figure 10B:
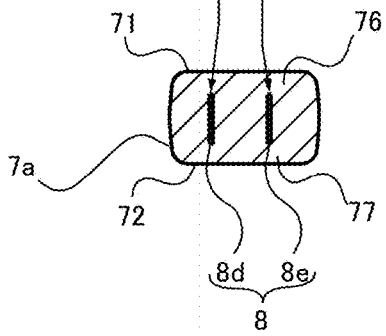

Configuration of the rear stop 7 will be discussed in detail with reference to FIGS. 8 to 12. As illustrated in FIGS. 8 to 10, the rear stop 7 has a first superficial region (upper region) 76 formed at a side of the top surface 71 of the main body 7*a*, a second superficial region (lower region) 77 formed at a side of the bottom surface 72 of the main body 7*a*, and a slit or interface 8 interposed between the top and bottom surfaces 71 and 72 of the main body 7*a*. In the present embodiment, the first superficial region 76 extends over and covers the slit or interface 8, and has a thickness R1 defined between the top surface 71 and the top end 81 of the slit or interface 8. Likewise, the second superficial region 77 extends over and covers the slit or interface 8, and has a thickness R2 defined between the bottom surface 72 and the bottom end 82 of the slit or interface 8. Even though the slit or interface 8 is formed in the rear stop 7, sufficient mechanical strength of the rear stop 7 for coupling the left and right fastener tapes 3*a* and 3*b* would be ensured owing to those first and/or second superficial region 76,77. Furthermore, deterioration of appearance of the rear stop 7 is suppressed compared with a rear stop produced through one shot injection molding, owing to the first and/or the second superficial region 76,77.

The slit or interface 8 extends between the front surface 73 and the rear surface 74 of the main body 7*a*, corresponding to the slit 8' between the first and second resin portions 31 and 32. Preferably, the first superficial region 76 covers the slit or interface 8 in its full span in front-rear direction between the front and rear surfaces 73 and 74 of the main body 7*a*, resulting in unexposed slit or interface 8 in the top surface 71 of the main body 7*a*. Likewise, the second superficial region 77 covers the slit or interface 8 in its full span in front-rear direction between the front and rear surfaces 73 and 74 of the main body 7*a*, resulting in unexposed slit or interface 8 in the bottom surface 72 of the main body 7*a*.

Even in a case where the slit or interface 8 is covered by the superficial region, the slit or interface 8 may be visible externally through the superficial region. In order to make the slit or interface 8 less visible externally through the superficial region, surface processing (e.g. surface roughening processing) may be applied to the top surface 71 or the bottom surface 72 of the main body 7*a* simultaneously as or after the mold is heated as described above. For this or other purposes, a pattern such as a logo can be formed on the top surface 71 or the bottom surface 72 of the main body 7*a*. This pattern may be visible as protrusion, recess or combination of the two formed on the top surface 71 or the bottom surface 72 of the main body 7*a*, but should not be limited to this. Conveniently, a recess or protrusion is formed on a cavity surface of the mold (the lower mold 101 and/or upper mold 102) for melting resin, and the pattern of recess or protrusion is copied to the main body 7*a*.

Intermediate region 7*m* is interposed between the first and second superficial regions 76 and 77. The first and second superficial regions 76 and 77 are subjected to greater heat than the intermediate region 7*m*. Therefore, an interface may be formed between the first superficial region 76 and the intermediate region 7*m*, and an interface may be formed between the second superficial region 77 and the intermediate region 7*m*, but should not be limited to this. Basically, the first superficial region 76, the intermediate region 7*m* and the second superficial region 77 configure a continuous region. Boundary between the first superficial region 76 and the intermediate region 7*m* may be defined based on a position of the top end 81 of the slit or interface 8 just for a convenient purpose. Likewise, boundary between the second superficial region 77 and the intermediate region 7*m* may defined based on a position of the bottom end 82 of the slit or interface 8 just for a convenient purpose.

The thicknesses R1,R2 of the first and second superficial regions 76,77 are correlated to the target temperature of the mold 100 and/or the duration of target temperature. For example, if the duration of target temperature of the mold 100 increases, the span W8 of the slit or interface 8 in the up-down direction reduces and thicknesses R1,R2 of the first and second superficial regions 76,77 increase accordingly, thus enhancing its robustness. However, there is a possibility of overheating the fastener tape 3*a*,3*b* and heating the fastener elements 4*a*,4*b* together. If the duration of target temperature of the mold 100 is reduced, a required production time is shortened but the thicknesses R1,R2 of the first and second superficial regions 76,77 decrease. From such a viewpoint, the thickness R1,R2 of the first and second superficial regions 76,77 may be equal to or greater than 0.2 mm, ensuring a required amount melted resin. As an additional or alternative condition, the first superficial region 76 is formed to have a thickness R1 that is equal to or less than a half a thickness TH7 defined by the top and bottom surfaces 71,72 of the main body 7*a* or a width W8 of the slit or interface 8 in the up-down direction. The same applies to the thickness R2 of the second superficial region 77. Note that a maximum value of the thickness R1 of the first superficial region 76 may be equal to a distance in the up-down direction between the top surface 71 of the main body 7*a* and the tape top surface (or a top point of the core thread). A maximum value of the thickness R2 of the second superficial region 77 may be equal to a distance in the up-down direction between the bottom surface 72 of the main body 7*a* and the tape bottom surface (or a bottom point of the core thread).

Figure 11A:
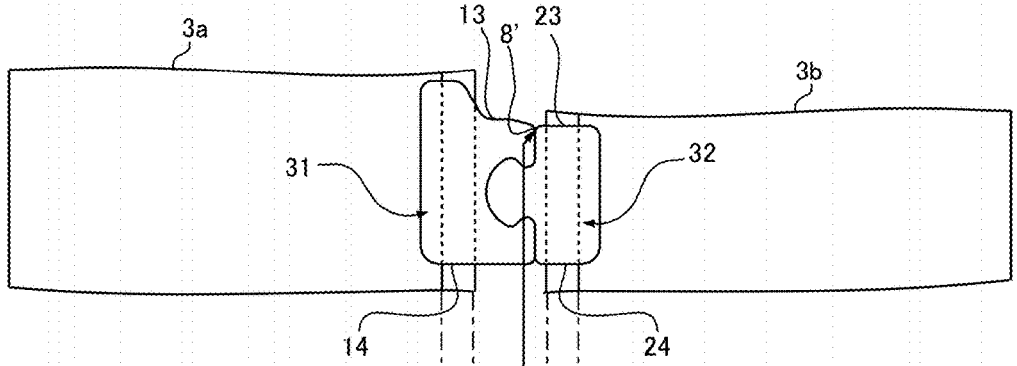
FIGS. 11 (A) and 11 (B), collectively FIG. 11 are schematic illustrations illustrating that the slit between the first and second resin portions disappears in the vicinity of front surface of the stop member, FIG. 11 (A) illustrating the first and second resin portions before heated and melted, and FIG. 11 (B) illustrating a cross section of the stop member taken along a dash line X-X in FIG. 1.
Figure 11B:
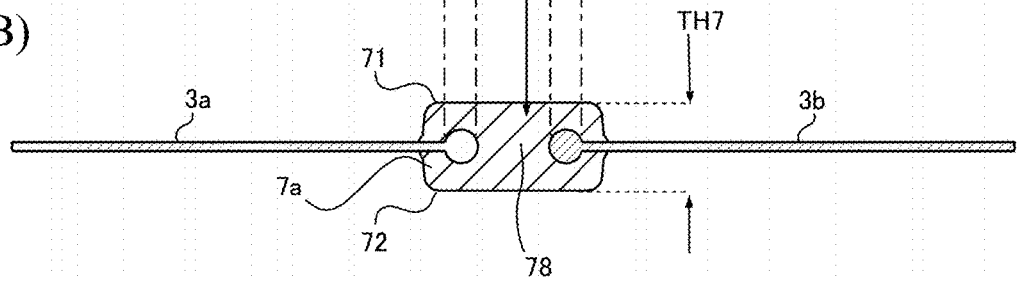
Figures 12A, 12B:
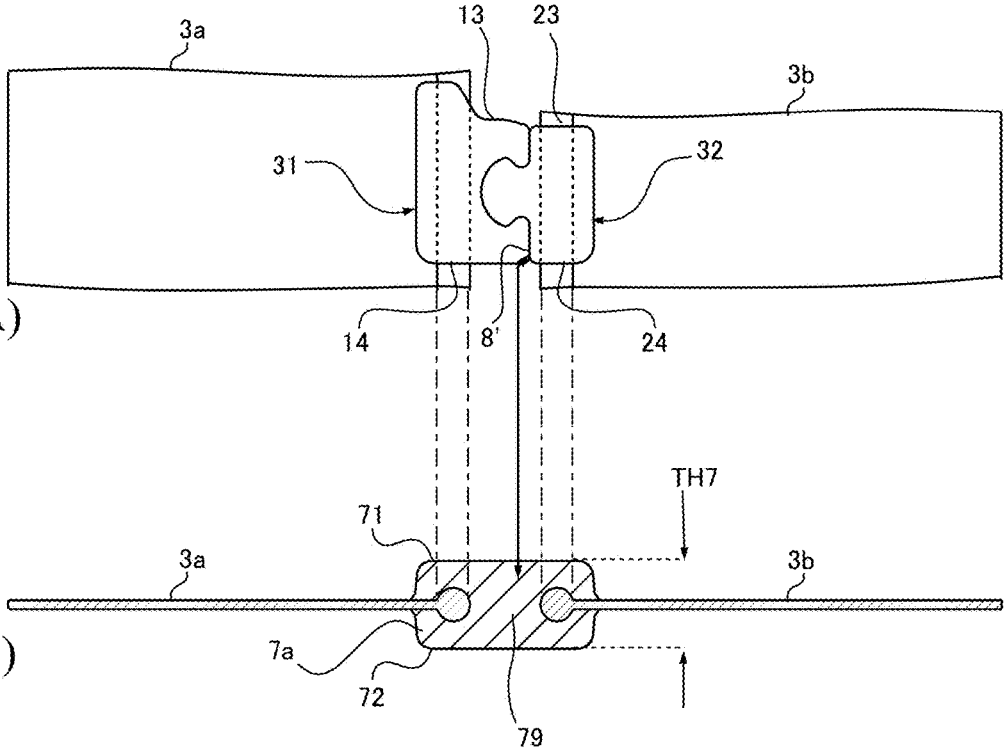
FIGS. 12 (A) and 12 (B), collectively FIG. 12 are schematic illustrations illustrating that the slit between the first and second resin portions disappears in the vicinity of rear surface of the stop member, FIG. 12 (A) illustrating the first and second resin portions before heated and melted, and FIG. 12 (B) illustrating a cross section of the stop member taken along a dash line XI-XI in FIG. 1.

The slit or interface 8 may be covered by a third superficial region 78 formed at a side of the front surface 73 of the main body 7*a* and/or covered by a fourth superficial region 79 formed at a side of the rear surface 74 of the main body 7*a* (See FIGS. 11 and 12). The third and fourth superficial regions 78,79 extend over and cover the slit or interface 8. Exposure of the slit or interface 8 in the front surface 73 of the main body 7*a* may be at least partially prevented by the third superficial region 78. Exposure of the slit or interface 8 in the rear surface 74 of the main body 7*a* may be at least partially prevented by the fourth superficial region 79. Note that the third superficial region 78 has a thickness defined between the front surface 73 and the front end of the slit or interface 8, and the fourth superficial region 79 has a thickness defined between the rear surface 74 and the rear end of the slit or interface 8. The slit or interface 8 may be covered in its full span in the up-down direction by the third or fourth superficial region 78,79, but should not be limited to this.

The slit or interface 8 is formed to demarcate a boundary between a female portion 31*c*' and a male portion 32*c*' included in the main body 7*a*. Superficial layers of the first and second resin portions 31,32 are melted to partially cover the slit 8' therebetween, configuring the main body 7*a*. Therefore, in cases where the first and second resin portions 31 and 32 include female and male portions 31*c* and 32*c*, the main body 7*a* would include female and male portions 31*c*' and 32*c*'. It should be noted that, the female portion 31*c* of the first resin portion 31 and the female portion 31*c*' of the main body 7*a* are not fully identical due to the melting of the superficial layers of the first and second resin portions 31,32. The same applies to the male portion 32*c* of the second resin portion 32 and the male portion 32*c*' of the main body 7*a*. The female portion 31*c*' has a female surface extending to form a recess, and the male portion 32*c*' has a male surface extending to form a protrusion. The female and male surfaces are arranged to face one another with interspace or they are in contact.

For example, the slit or interface 8 in FIG. 8 is formed at a boundary between the bottom surface of the recess of the female portion 31*c*' of the main body 7*a* and a top surface of the protrusion of the male portion 32*c*' of the main body 7*a*. If the bottom surface of the recess of the female portion 31*c*' of the main body 7*a* and the top surface of the protrusion of the male portion 32*c*' of the main body 7*a* are opposing with interspace, a slit would be formed between them. If the bottom surface of the recess of the female portion 31*c*' of the main body 7*a* and the top surface of the protrusion of the male portion 32*c*' of the main body 7*a* are in intimate contact, an interface would be formed between them.

Shape and/or number of the slit or interface 8 that is observable in a cutting plane may differ among separate cutting positions. For example, as understood by comparing FIGS. 8-10, the number of slit or interface 8 is one in the case of FIG. 8, the number of slit or interface 8 is three in the case of FIG. 9, and the number of slit or interface 8 is two in the case of FIG. 10. In FIG. 9, a cross section of the head of the male portion 32*c*' is interposed between slit 8*a* and slit 8*b*, and a cross section of the constricting portion of the female portion 31*c*' is interposed between slit 8*b* and slit 8*c*. In FIG. 10, a cross section of the male portion 32*c*' is interposed between slit 8*d* and slit 8*e*. It may be possible to understand that increased number of slit or interface 8 observable in a given cross section (e.g. two, three or four) contributes to enhance mechanical strength of the rear stop 7. Note that, in FIG. 9, the slit or interface 8*a*-8*c* each extends in the up-down direction between the first superficial region 76 and the second superficial region 77, and does not reach any of the top and bottom surfaces 71 and 72 of the main body 7*a*.

The slit or interface 8 is interposed between the side-edge portions 3*c*,3*d* (e.g. the core threads) of the fastener tapes 3*a*,3*b*, but should not be limited to this. The span of the slit or interface 8 in the up-down direction is equal to or greater than the thickness of the core thread in the up-down direction, but should not be limited to this.

Figure 13:
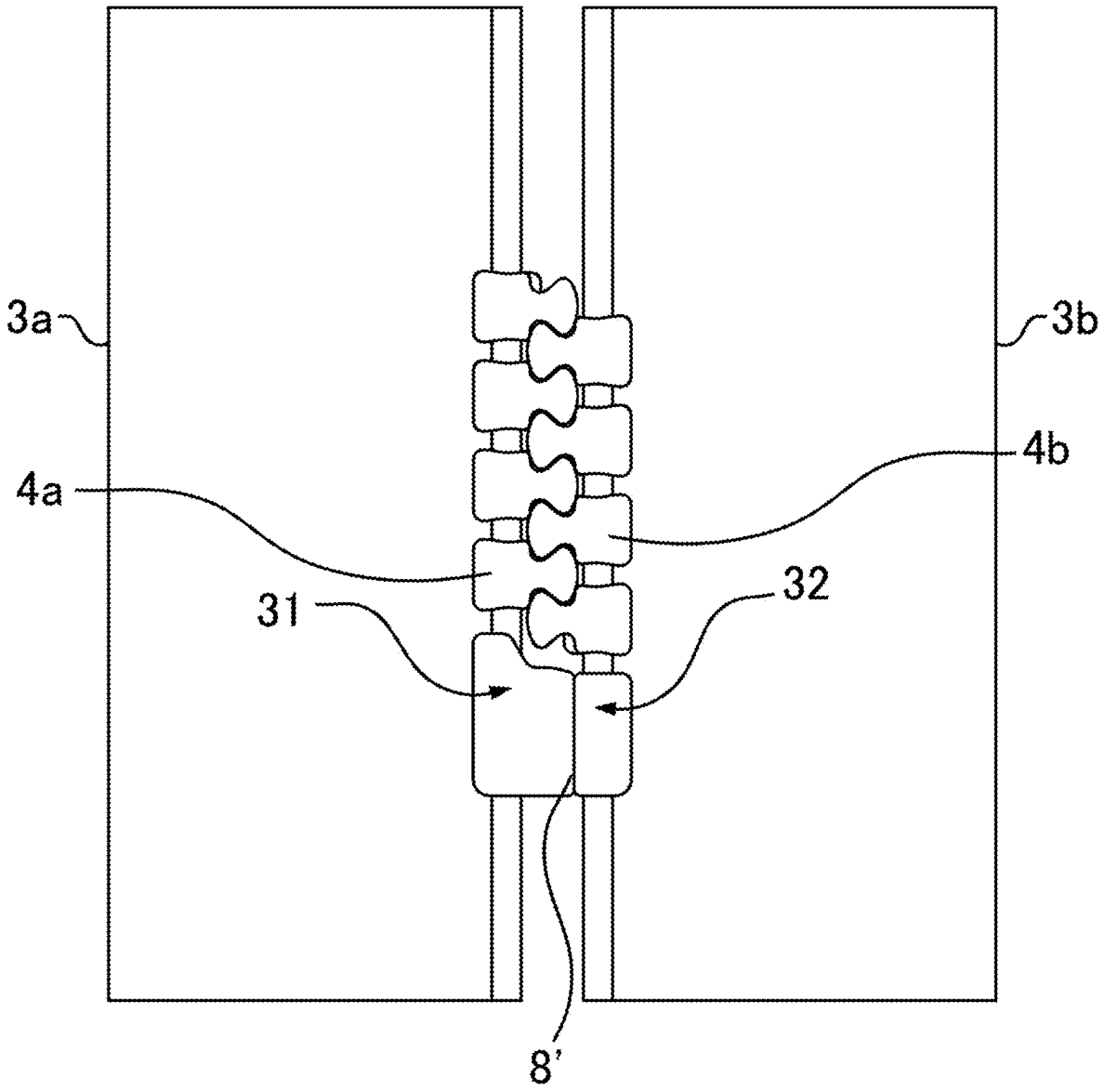
FIG. 13 is a schematic illustration illustrating an embodiment where first and second resin portions are simply overlapped.
Figure 14:
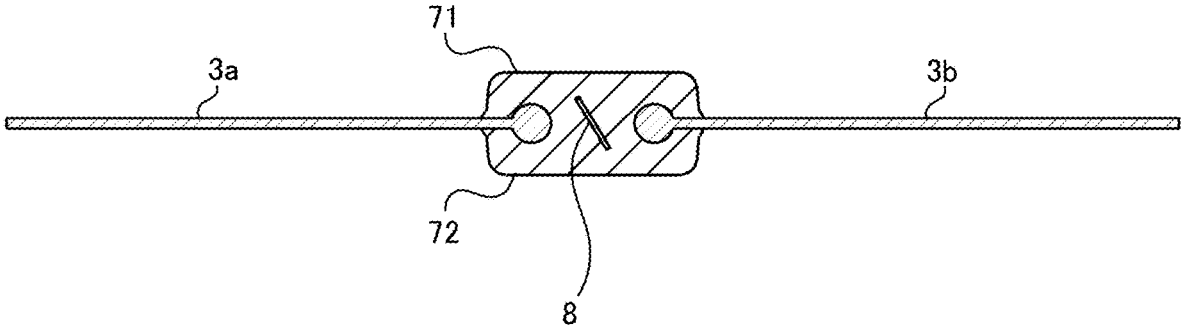
FIG. 14 is a schematic cross-sectional view of a stop member obtained through remelting of the first and second resin portions illustrated in FIG. 13.

In another embodiment illustrated in FIG. 13, the right-side surface (the side facing outward of fastener tape) 16 of the first resin portion 31 and the left-side surface (the side facing outward of fastener tape) 26 of the second resin portion 32 (collectively, opposed surfaces of the first and second resin portions 31,32) are both formed as sloped surfaces and are overlaid. As a result of this, as the superficial layers of the first and second resin portions 31,32 are melted and in turn solidified in the cavity 105 of the mold 100, the slit or interface 8 is formed to extend obliquely as illustrated in FIG. 14. As such, the shape of slit or interface 8 in a given cross section would vary depending on a manner of engagement between the first and second resin portions 31,32. Various modified examples are envisioned with respect to the manner of engagement between the first and second resin portions 31,32 other than the illustrated ones, and it would be redundant for a skilled person in the art to describe each and every example and thus omitted.

Figure 15:
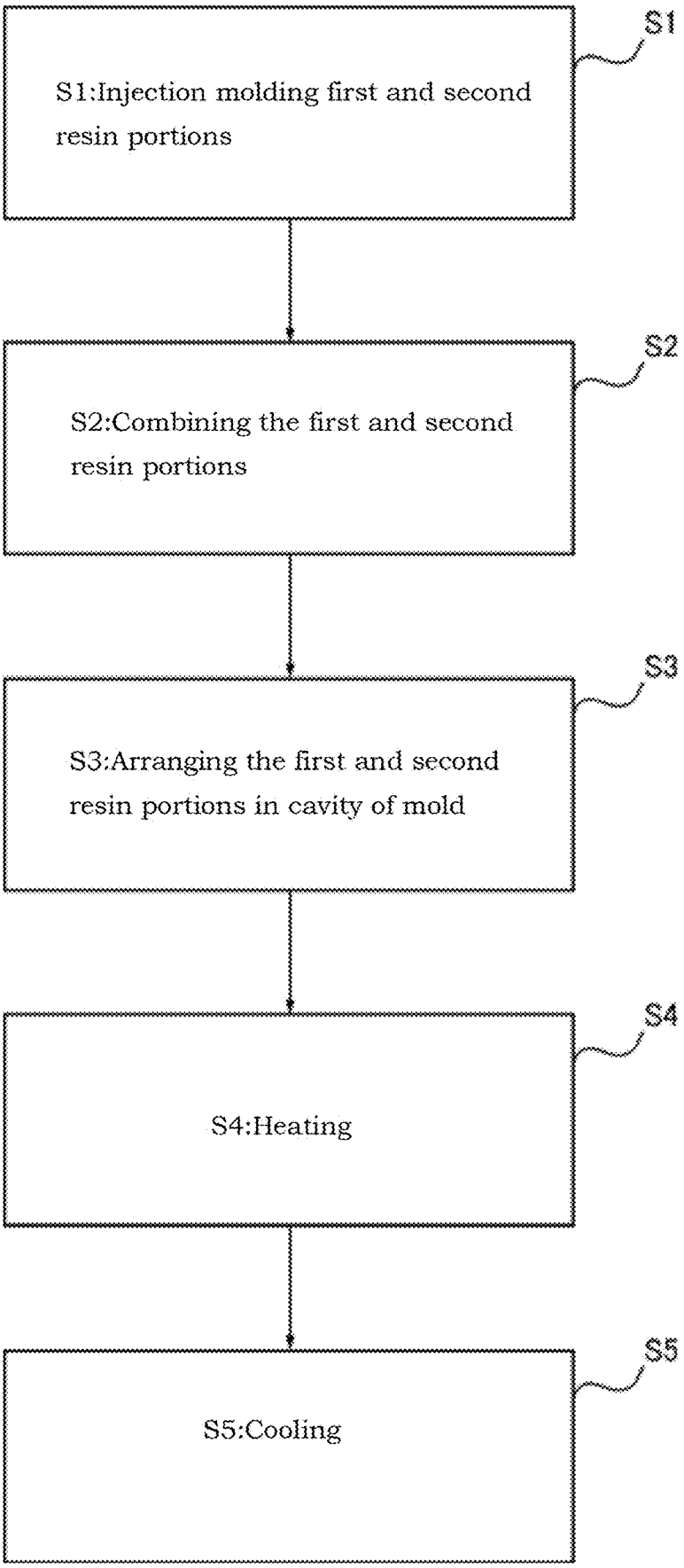
FIG. 15 is a schematic flowchart showing a method of production of slide fastener according to an aspect of the present disclosure.

In summary, a method of producing a rear stop 7 of slide fastener 1 will be described with reference to FIG. 15. Firstly, at least one first resin portion 31, which will be a part of the rear stop 7, is injection molded to the side-edge portion 3*c* of the fastener tape 3*a* (S1). In addition to this, at least one second resin portion 32, which will be a remaining part of the rear stop 7, is injection molded to the side-edge portion 3*d* of the fastener tape 3*b* (S1). Preferably, the fastener elements 4*a* are injection molded to the side-edge portion 3*c* of the fastener tape 3*a* together with the first resin portion 31. Likewise, the fastener elements 4*b* are injection molded to the side-edge portion 3*d* of the fastener tape 3*b* together with the second resin portion 32.

Next, the first and second resin portions 31 and 32 are coupled (S2). In cases where the first and second resin portions 31,32 include the female and male portions 31*c*' and 32*c*', these portions would be engaged. Common slider 5 may be used to engage the fastener elements 4*a* and 4*b* and to engage the female and male portions 31*c*' and 32*c*'. Needless to say this step S2 can be omitted.

Next, the first and second resin portions 31 and 32 are arranged in a cavity 105 of a mold 100 to form a slit 8' between the first and second resin portions 31 and 32 (S3). More specifically, the first and second resin portions 31 and 32 are arranged in the cavity 111 of the lower mold 101 respectively or after coupling them. Next, an upper mold 102 is stacked to the lower mold 101. As such, the first and second resin portions 31,32 are arranged in the cavity 105 of the mold 100.

Next, the mold 100 is heated (S4). Target temperature of the mold 100 and the duration are appropriately set in accordance with the resin material. The first and second resin portions 31,32, particularly the superficial regions are melted in the vicinity of the cavity surfaces of the cavity 105. The melted resin partially fills the slit 8'. In some cases, the mold 100 may be configured to have a thermal conductivity distribution adapted to selectively melt a superficial region in the vicinity of the slit 8' between the first and second resin portions 31,32. The superficial region of the first and second resin portions 31,32 is melted in the cavity 105 of the mold 100, whereby gate marks on the first and second resin portions 31,32 disappear. Therefore, no gate mark is formed on the rear stop 7. Note that a game mark is a trace formed as a result of cutting at a connection point with a gate channel through which melted resin flows.

Next, the mold 100 is cooled (S5). The slit 8' between the first and second resin portions 31 and 32 is partially filled by the melted and solidified resin. As a result, a stop member is formed in which a slit or interface 8 is covered by at least one superficial region made of the melted and solidified resin. The slit or interface 8 of the rear stop 7 may be an internal slit or internal interface substantially or totally surrounded by the first, second, third and fourth superficial regions 76,77,78,79, but should not be limited to this.

Figure 16:
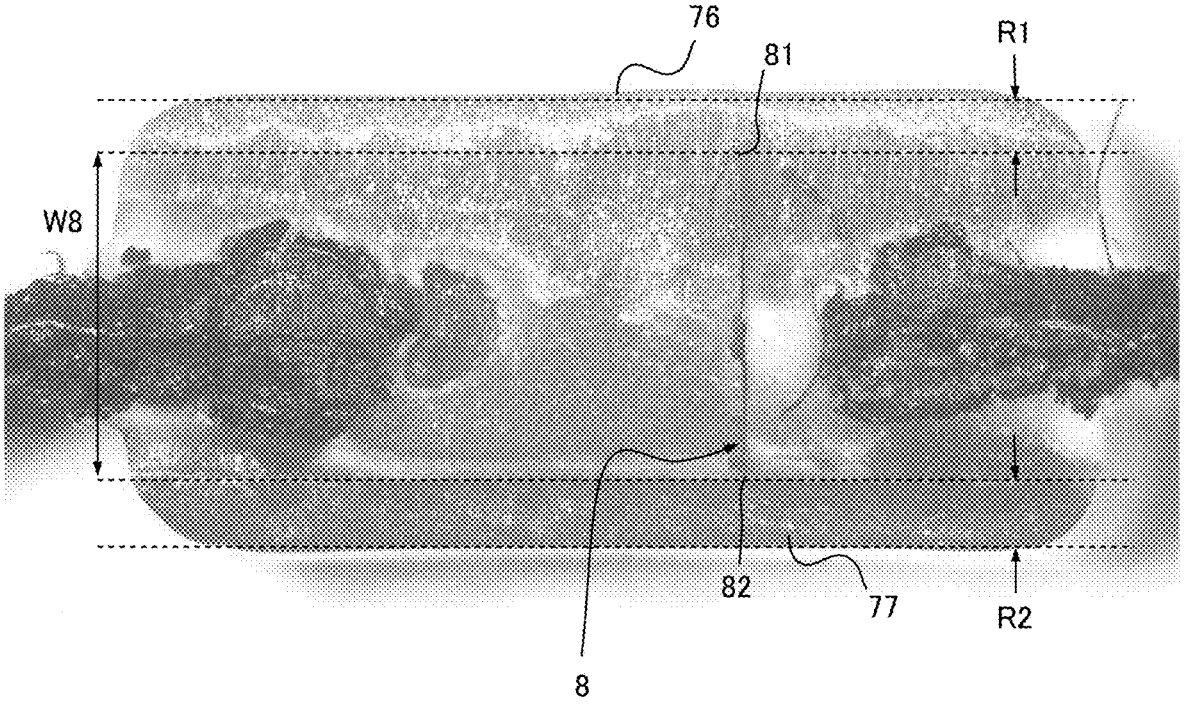
FIG. 16 is a photograph of stop member in cross section which is produced based on the present disclosure.

FIG. 16 is a photograph of a sample in cross section corresponding to FIG. 8. As understood from FIG. 16 either, the descriptions with reference to FIG. 8 and so on are based on actual experimentation.

Following inventions are also disclosed in the present specification.

APPENDIX 1

A stop member of a slide fastener, the stop member coupling first and second fastener stringers one another in which first and second fastener elements are aligned on opposing side-edge portions of first and second fastener tapes, the stop member comprising:

a main body having a top surface and a bottom surface;

an upper superficial region formed at a side of the top surface of the main body;

a lower superficial region formed at a side of the bottom surface of the main body; and a slit or interface interposed between the top surface and the bottom surface of the main body, wherein the upper and lower superficial regions are superficial regions that extend over the slit or interface to cover the slit or interface.

Based on the above teachings, a skilled person in the art would be able to add various modifications to the respective embodiments. Reference numerals in claims are just for reference and should not be referred for a purpose of narrowly construing the scope of claims. The present disclosure is applicable not only to a rear stop of slide fastener but also to a front stop thereof. The superficial region is not necessarily a flat layer but may be shaped differently such as an arc depending on a shape of stop member.

REFERENCE NUMERALS

1: Slide fastener
2*a*,2*b*: Fastener stringer
3*a*,3*b*: Fastener tape
3*c*,3*d*: Side-edge portion
4*a*,4*b*: Fastener element
5: Slider
7: Rear stop (stop member)
7*a*: Main body
8: Slit or Interface
8': Slit
31: First resin portion

32 Second resin portion
76: First superficial region
77 Second superficial region
78 Third superficial region
79: Fourth superficial region
100: Mold
105: Cavity

The invention claimed is:

1. A stop member for slide fastener, the stop member comprising:

a main body having first surface, second surface, third surface and fourth surface, the first and second surfaces being on opposite sides, and the third and fourth surfaces being on opposite sides;

a first superficial region formed at a side of the first surface of the main body;

a second superficial region formed at a side of the second surface of the main body; and a slit or interface interposed between the first and second surfaces of the main body, wherein the first superficial region extends over and covers the slit or the interface, and has a thickness defined between the first surface and an end of the slit or the interface at the side of the first surface, and the second superficial region extends over and covers the slit or the interface, and has a thickness defined between the second surface and an end of the slit or the interface at the side of the second surface, the stop member further comprising:

a third superficial region formed at a side of the third surface to prevent at least a part of the slit or the interface from being exposed in the third surface, and a fourth superficial region formed at a side of the fourth surface to prevent at least a part of the slit or the interface from being exposed in the fourth surface.

2. The stop member for the slide fastener of claim 1, wherein the first surface is a top surface of the main body, and the second surface is a bottom surface of the main body.

3. The stop member for the slide fastener of claim 2, wherein the slit or the interface is not exposed in both of the first surface and the second surface.

4. The stop member for the slide fastener of claim 2, wherein the main body further has a front surface and a rear surface arranged at an opposite side of the front surface, the first superficial region covers the slit or the interface in a full span of the slit or the interface in front-rear direction between the front surface and the rear surface of the main body, and the second superficial region covers the slit or the interface in a full span of the slit or the interface in front-rear direction between the front surface and the rear surface of the main body.

5. The stop member for the slide fastener of claim 2, wherein the thickness of the first superficial region and/or the thickness of the second superficial region is equal to or greater than 0.2 mm or is equal to or less than half a thickness defined by the first and second surfaces of the main body.

6. The stop member for the slide fastener of claim 1, wherein a number of the slit or the interface observed in a given cross section of the main body is equal to or greater than 2 or 3.

7. The stop member for the slide fastener of claim 1, wherein the slit or the interface is formed to demarcate a boundary between a female portion and a male portion included in the main body.

8. The stop member for the slide fastener of claim 1, wherein the first surface is a top surface of the main body, and the second surface is a bottom surface of the main body, the top surface and the bottom surface each being a flat surface that extends over the slit or the interface.

9. The stop member for the slide fastener of claim 1, wherein no gate mark is formed on the main body.

10. A method of producing a slide fastener, the method comprising:

injection molding at least one first resin portion, which will be a part of a stop member, to a side-edge portion of a first fastener tape;

injection molding at least one second resin portion, which will be a remaining part of the stop member, to a side-edge portion of a second fastener tape;

arranging the first and second resin portions in a cavity of a mold to form a slit between the first and second resin portions;

heating the mold to melt superficial regions of the first and second resin portions in the cavity of the mold such that the slit is partially filled by melted resin of the superficial regions; and cooling the mold to form the stop member that has a slit or interface covered by at least one superficial region made of a solidified resin of the melted resin.

11. The method of producing the slide fastener of claim 10, further comprising coupling the first and second resin portions based on engagement between female portion and male portion of the first and second resin portions in advance of said arranging the first and second resin portions in the cavity of the mold.

12. The method of producing the slide fastener of claim 11 in which a row of first fastener elements is injection-molded to the side-edge portion of the first fastener tape, and a row of second fastener elements is injection-molded to the side-edge portion of the second fastener tape, the method comprising:

using a slider designed for engaging the female portion and the male portion of the first and second resin portions to engage the first fastener elements and the second fastener elements one another.

13. The method of producing the slide fastener of claim 10, wherein the stop member having no gate mark is formed through heating and cooling of the mold.

* * * * *